US006705952B1

(12) United States Patent
Vecsey

(10) Patent No.: US 6,705,952 B1
(45) Date of Patent: Mar. 16, 2004

(54) GOLF CLUB WITH AN INTERNAL MECHANISM FOR MEASURING THE FORCE OF A GOLF SWING

(76) Inventor: Frank Vecsey, 106 Main St., Garfield, NJ (US) 07026

( * ) Notice: Subject to any disclaimer, the term of this patent is extended or adjusted under 35 U.S.C. 154(b) by 0 days.

(21) Appl. No.: 10/376,698

(22) Filed: Feb. 28, 2003

(51) Int. Cl.[7] ..... A63B 69/36
(52) U.S. Cl. ..... 473/232
(58) Field of Search ..... 473/231, 232, 473/233, 237, 238, 239, 242, 219, 226; 73/379.01, 493

(56) References Cited

U.S. PATENT DOCUMENTS

| | | | | | |
|---|---|---|---|---|---|
| 2,223,647 | A | * | 12/1940 | Stumpf | 473/233 |
| 2,543,722 | A | * | 2/1951 | Stumpf | 473/233 |
| 2,986,937 | A | * | 6/1961 | Hetzel | 473/233 |
| 3,561,272 | A | * | 2/1971 | Chapman | 473/233 |
| 3,572,706 | A | * | 3/1971 | Schroder | 473/234 |
| 4,146,231 | A | | 3/1979 | Merkle et al. | |
| 4,270,753 | A | * | 6/1981 | Maroth et al. | 473/233 |
| 4,304,406 | A | | 12/1981 | Cromarty | |
| 4,363,488 | A | * | 12/1982 | Maroth et al. | 473/233 |
| 4,788,863 | A | * | 12/1988 | Tanaka | 73/493 |
| 4,932,661 | A | * | 6/1990 | Choi | 473/239 |
| 4,967,596 | A | * | 11/1990 | Rilling et al. | 73/492 |
| 5,154,427 | A | | 10/1992 | Harlan et al. | |
| 6,231,453 | B1 | * | 5/2001 | Jebe | 473/233 |
| 2003/0017882 | A1 | * | 1/2003 | Hossack | 473/222 |

* cited by examiner

*Primary Examiner*—Raleigh W. Chiu
(74) *Attorney, Agent, or Firm*—Goldstein Law Offices, P.C

(57) ABSTRACT

A golf club with an internal mechanism for measuring the force of a golf swing, and consequently, the distance a golf ball will travel when hit by the golf swing. The mechanism comprises a marker barrel, an attached distance rod, and an associated main spring. When the golf club is swung, centrifugal force causes the marker barrel and the attached distance rod to be displaced a particular distance within the main spring. The distance of this displacement is limited by the tension that this displacement causes in the main spring. The position of the marker barrel may be seen through circular openings within the shaft. Each circular opening is labeled with indicia indicating the distance a ball would travel had it been hit with the force which caused the marker barrel to move to that position. The golf club additionally has a release mechanism which allows the marker barrel to return to its pre-swing position after the swing is complete.

5 Claims, 3 Drawing Sheets

GOLF CLUB WITH AN INTERNAL MECHANISM FOR MEASURING THE FORCE OF A GOLF SWING

BACKGROUND OF THE INVENTION

1. Field of the Invention

The invention relates generally to an accessory for improving a golf swing, and in particular to an accessory having an internal mechanism for measuring the force of a golf swing.

2. Description of the Related Art

Millions of people enjoy the game of golf. Prior to hitting a golf ball during a game of golf, a golfer must determine the optimal force with which to hit the golf ball, because this will determine the distance the golf ball will travel. Consequently, there is a need for a golf club which allows a user to gauge, before actually hitting the ball, the optimal force with which to hit the golf ball.

A variety of golf practice devices are available for improving various aspects of a golfer's swing. For example, U.S. Pat. No. 4,305,406 to Cromarty appears to show a golf practice device comprised of a number of sensors for determining the position of a head of a golf club during a swing. However, Cromarty provides no information as to the force with which the golfer has swung the club, and therefore does not help the golfer determine how far a golf ball will travel when hit by the head of the golf club.

Similarly, U.S. Pat. No. 5,154,427 to Harlan appears to show a golf practice device capable of tracking the real time movement of a golf club during a swing. Harlan, however, also fails to provide any information as to the distance a golf ball will travel after being hit by the head of the club.

U.S. Pat. No. 4,146,231 to Merkle appears to show a golf practice device having a platform to assist a player in establishing a proper weight distribution while swinging a golf club. However, Merkle contemplates an apparatus primarily designed to improve a golfer's stance during the swing, and is not designed to allow a user to estimate the force of the golf swing and the distance a golf ball would travel upon impact.

While these units may be suitable for the particular purpose employed, or for general use, they would not be as suitable for the purposes of the present invention as disclosed hereafter.

SUMMARY OF THE INVENTION

It is an object of the invention to provide a golf club with a mechanism for measuring the force of a swing of the golf club. Accordingly, the golf club has a distance-determining mechanism within its shaft, comprising a movable marker barrel and an associated main spring. During a golf swing, centrifugal force exerted upon the marker barrel causes the marker barrel to move within the shaft, thereby causing the associated main spring to extend. The position of the marker barrel within the shaft is visible to the user, and provides an accurate measure of the force of the swing.

It is another object of the invention to produce a golf club which allows a user to estimate the distance a golf ball will travel after being hit by a swing of a golf club of a particular force. Accordingly, the marker barrel moves within the shaft of the club when the club is swung. The position of the marker barrel within the shaft can provide the user with an accurate measure of the distance the golf ball would travel after being hit by a similar swing of the golf club.

It is another object of the invention to produce a golf club wherein the marker barrel remains at its extended position after the swing, so that a user may view the position of the marker barrel in order to gauge the force of the swing. Accordingly, the golf club has a release mechanism having a "locked" position, for immobilizing the marker barrel at the extended post-swing position. The release mechanism may subsequently be unlocked by pushing a release button.

The invention is a golf club with an internal mechanism for measuring the force of a golf swing, and consequently, the distance a golf ball will travel when hit by the golf swing. The mechanism comprises a marker barrel, an attached distance rod, and an associated main spring. When the golf club is swung, centrifugal force causes the marker barrel and the attached distance rod to be displaced a particular distance within the main spring. The distance of this displacement is limited by the tension that this displacement causes in the main spring. The position of the marker barrel may be seen through circular openings within the shaft. Each circular opening is labeled with indicia indicating the distance a ball would travel had it been hit with the force which caused the marker barrel to move to that position. The golf club additionally has a release mechanism which allows the marker barrel to return to its pre-swing position after the swing is complete.

To the accomplishment of the above and related objects the invention may be embodied in the form illustrated in the accompanying drawings. Attention is called to the-fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
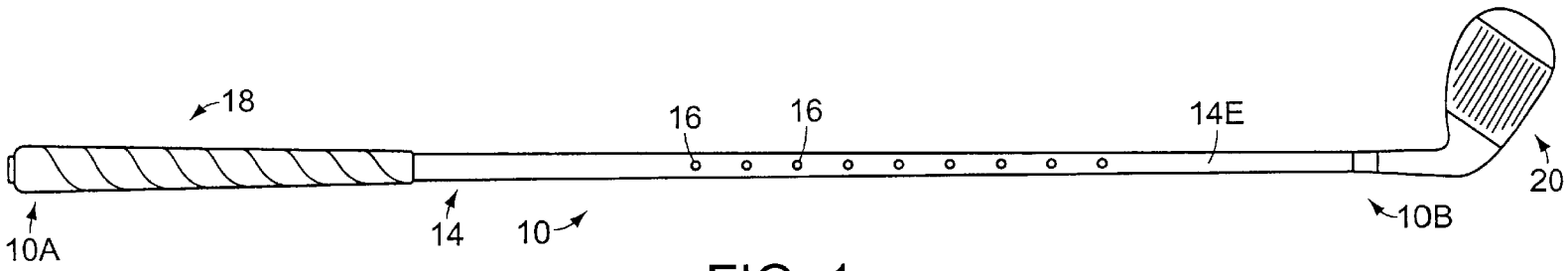
FIG. 1 is a side view of the golf club.

FIG. 1 illustrates a side view of a golf club 10 having a first end 10A having a handle portion 18, a second end 10B having a club head 20, and an elongated shaft 14 located between the first end 10A and the second end 10B. The handle portion 18 and the shaft 14 are substantially hollow and tapered toward the club head 20. The shaft 14 has an external surface 14E and an internal bore extending longitudinally substantially between the first end 10A and second end 10B. The internal bore is not visible in FIG. 1. The shaft 14 has a plurality of longitudinally arranged circular openings 16 which extend fully from the external surface 14E to the internal bore of the shaft 14.

Figure 2:
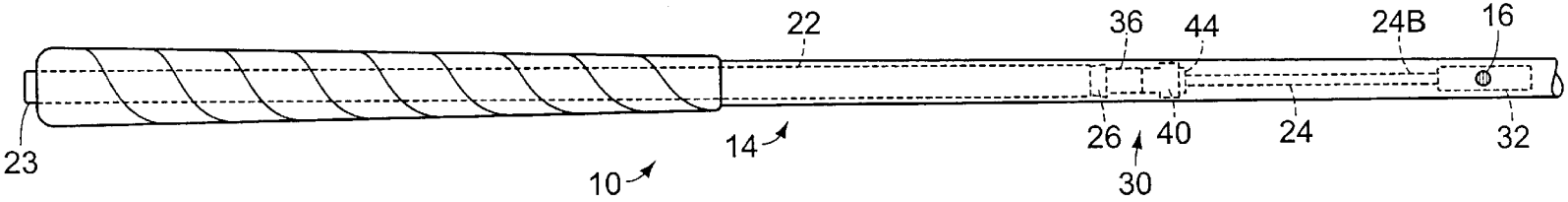
FIG. 2 is a side view of a portion of the golf club before the club has been swung, illustrating the position of the distance rod and marker barrel.

The golf club 10 includes both a distance-determining mechanism and a release mechanism 30 within its substantially hollow shaft 14 and handle portion 18. FIG. 2 provides a general overview of the position of both these mechanisms within the internal bore of the club 10 in a pre-swing position. The distance-determining mechanism comprises a selectively movable marker barrel 32, a distance rod 24 rigidly attached thereto, and an associated main spring 34. The golf club 10 also has a release mechanism 30 for selectively immobilizing the distance rod 24 and the attached marker barrel 32, both before and after a golf swing. The release mechanism 30 automatically unlocks during a swing from the force of the swing, thereby allowing the distance rod 24 and the attached marker barrel 32 to move within the handle portion 18 and the shaft 14 to a longitudinal position indicative of the force of the swing.

Figure 3:
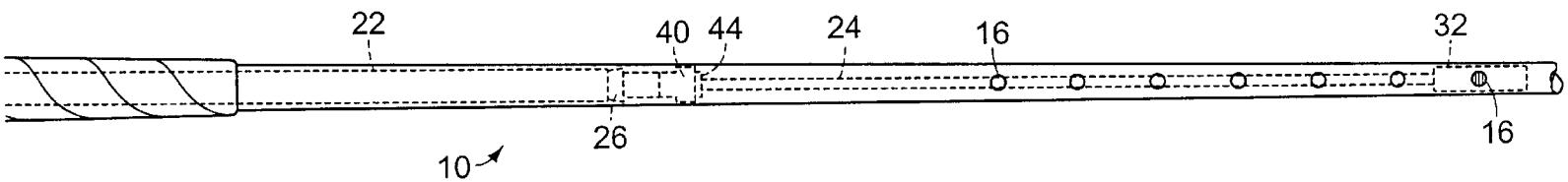
FIG. 3 is a side view of a further distal portion of the golf club after the club has been swung, wherein the position of the marker barrel may be readily seen through circular openings within the shaft.

FIG. 3 illustrates the club 10 of FIG. 2 shifted to the left to illustrate the marker barrel 32 in a further distal position. Here, the centrifugal force of the swing has displaced the marker barrel 32 and the attached distance rod 24 from the pre-swing position indicated in FIG. 2. A measure of the displacement of the marker barrel 32 within the shaft 14 provides an accurate measure of the force of the swing, and thereby also provides a measure of the distance a golf ball will travel if it were hit by a swing of similar force. The amount by which the marker barrel 32 has been displaced by the swing is readily determined by viewing the position of the marker barrel 32 through the circular openings 16 within the shaft 14 which are provided for this purpose. Indicia label each circular opening 16 with the force of the swing which is necessary to bring the marker barrel 32 to that particular circular opening 16. Indicia also label each opening 16 with the distance that the golf ball would travel if it were directly hit with a swing of that particular force, or that distance can be determined by the golfer's experience when simply viewing the relative displacement of the marker barrel 32.

The release mechanism 30 comprises a release nut 26, a release spring 36, a collar 40, a release sleeve 44, a release tube 22, and a release button 23. The position of the collar 40 is fixed within the shaft 14 of the golf club 10. In FIG. 2, the marker barrel 32 is in its un-extended pre-swing position within the shaft 14, wherein the distance rod 24 is mostly located between the release mechanism 30 and the handle portion 18. In this position, a substantial portion of the distance rod 24, and the entire associated main spring 34, are obscured by the release tube 22. The operation of the release mechanism 30 will be described in further detail below.

Figure 4:
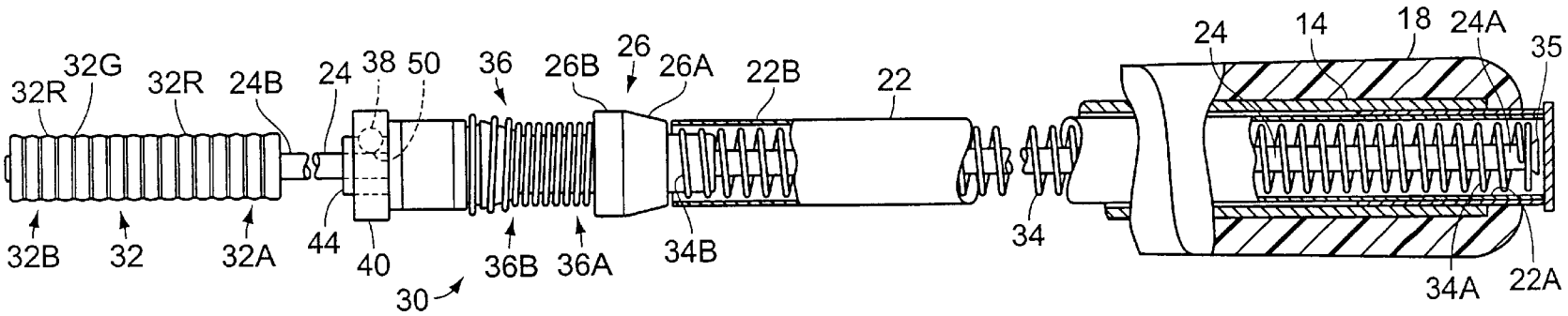
FIG. 4 is a side view of the internal mechanisms of the golf club, with portions of the invention broken away to reveal portions of the distance-determining mechanism.

FIG. 4 illustrates both the distance-determining mechanism and the release mechanism 30 prior to swinging the golf club 10. The distance rod 24 and attached marker barrel 32 are immobilized by the release mechanism 30 in their pre-swing, un-extended position, wherein the distance rod 24 extends substantially within the main spring 34 and release tube 22. The substantially cylindrical distance rod 24 has a first end 24A and a second end 24B. The attached marker barrel 32 also has a first end 32A and a second end 32B. Finally, the main spring 34 also has a first end 34A and a second end 34B. The first end 32A of the marker barrel 32 is attached to the second end 24B of the distance rod 24. The first end 24A of the distance rod 24 is attached to the first end 34A of the main spring 34. The first end 24A of the distance rod 24 has a flange 35 for engaging the first end 34A of the main spring 34 and compressing the main spring 34 as the distance rod 24 moves distally within the club 10. The second end 34B of the main spring 34 is attached to the release nut 26 as will be described hereinafter.

During a golf swing, centrifugal force is exerted upon the marker barrel 32. This causes the marker barrel 32 and the attached distance rod 24 to move towards the head 20 of the club 10. This motion is limited because as the distance rod 24 moves towards the head 20, the main spring 34 compresses until the centrifugal force which pulls the marker barrel 32 towards the second end 10B of the club 10 is balanced by the opposing tensional force of the main spring 34 against the release nut 26. The amount by which the main spring 34 is compressed by the swing, and hence, the distance which the associated distance rod 24 and the attached marker barrel 32 are able to extend during the swing, are directly proportional to the force of the swing.

After the swing, the release mechanism 30 automatically locks so that the marker barrel 32 and the distance rod 24 remain at their extended post-swing position within the shaft 14 until the user unlocks the release mechanism 30, as will be described hereinafter. The user is able to view the position of the immobilized marker barrel 32 within the shaft 14 of the club 10 through the circular openings 16 within the shaft 14. The marker barrel 32 is brightly colored, so that it may be easily seen through the circular openings 16. The marker barrel 32 has a plurality of ribs 32R, each having an associated groove 32G, so that brightly colored paint on the marker barrel 32 will remain within the grooves 32G, and will resist "wearing off" even after repeated use of the golf club 10.

Figure 5:
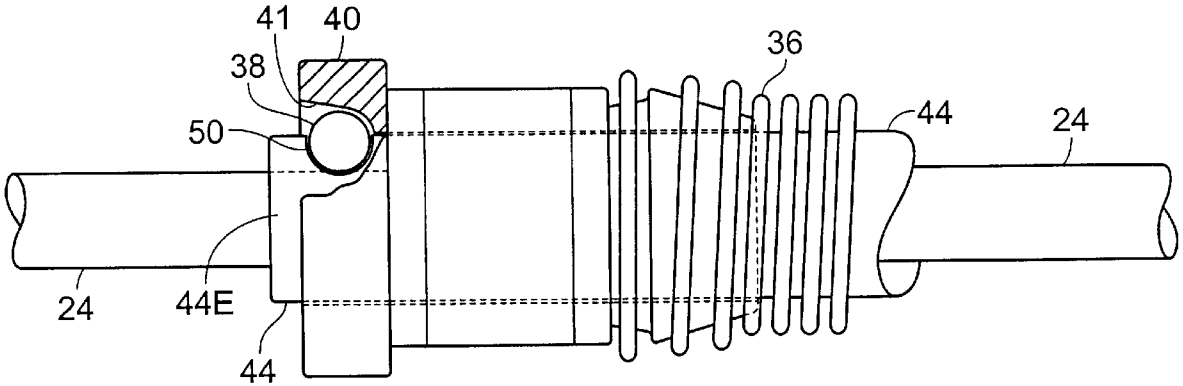
FIG. 5 is an enlarged side view detailing the release mechanism.

The release mechanism 30 has a "release" position and a "lock" position. The release mechanism 30 is "locked" both before and after a swing of the club 10. The release mechanism 30 is "released" during the swing of the club 10, in order that the distance rod 24 and attached marker barrel 32 may move freely to their post-swing position within the shaft 14. FIG. 5 is an enlarged side view taken generally in the area of circle 5 in FIG. 4, with a portion of the collar 40 broken away. Here, the release mechanism 30 is "locked" prior to swinging the club 10. In the "lock" position, the release mechanism 30 holds the enclosed distance rod 24 and the attached marker barrel 32 immobile within the shaft 14.

The release mechanism 30 has an immobile collar 40 and a selectively movable hollow release sleeve 44 having an external surface 44E and an internal bore. The release sleeve 44 extends coaxially within the collar 44 and is attached to the release nut 26. The distance rod 24 selectively extends coaxially within the internal bore of the release sleeve 44. The internal bore of the release sleeve 44 is not visible in the drawing figures. By virtue of the taper of the shaft 14, when the release mechanism 30 is installed into the club 10, the collar 40 becomes wedged within the internal bore of the club 10, and the position of the collar 40 is fixed within the shaft 14. The release sleeve 44 has a substantially hemispherical ball seat 50 extending fully from its external surface 44E to its internal bore. The release mechanism 30 has a spherical ball bearing 38 which rests within the ball seat 50, which is engaged by the overlying-collar 40. In FIG.

5, the ball bearing 38 within the ball seat 50 is firmly pressed by the overlying collar 40 against the enclosed distance rod 24 by a camming surface 41 within the collar 40, thereby immobilizing the distance rod 24 within the release mechanism 30 in its pre-swing position. The release mechanism 30 further comprises a release nut 26 having a first end 26A and a second end 26B, a release spring 36 having a first end 36A and a second end 36B, and a release tube 22 having a first end 22A and a second end 22B. A release button 23 located at the second end 22B of the release tube 22 is in mechanical contact with the release tube 22. The first end 34A of the release spring 34A is attached to the second end 34B of the release nut 26. The second end 34B of the release spring 34 is attached to the collar 40. In the absence of an applied force, the release spring 36 biases the release nut 34 away from the collar 40 and thus biases the release mechanism 30 to the locked-position wherein the ball bearing 38 is firmly held against the distance rod 24 by the camming surface 41 of the collar 40, thereby immobilizing the distance rod 24.

Force exerted upon the release nut 26 in the direction of the marker barrel 32 causes the release mechanism 30 to become "un-locked", by urging the release nut 34 momentarily toward the immobile collar 40. There are two origins of this "un-locking" force. Firstly, swinging the club 10 gives rise to a centrifugal force which urges all mass of the release mechanism 30 distally toward the club head 20. The collar 40 being immobilized, the release nut 26 pushes against the release spring 36 and carries the-release sleeve 44 distally (forward) to a position where it momentarily unlocks the release mechanism 30. Secondly, pressing the reset button 23, after the swing is completed, unlocks the release mechanism 30 by causing the second end 22B of the release tube 22 to press against the first end 34A of the release nut 34, thereby urging the release nut 34 and thus the release sleeve 44 rigidly attached thereto momentarily toward the collar 40, thereby causing the camming surface 41 of the collar 40 to cease pressing the ball bearing 38 against the distance rod 24, and thereby allows the compressed main spring 34 to expand and bring the distance rod 24 back to its pre-swing position.

Figure 6:
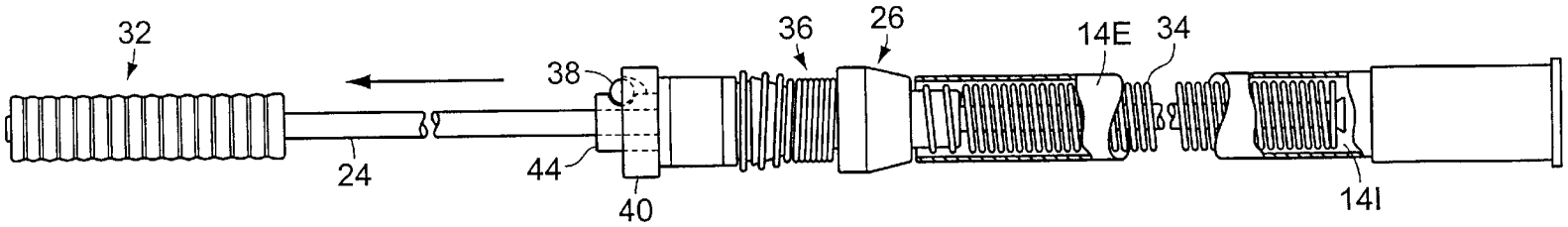
FIG. 6 is a side view of the release mechanism in a released position from the force of a golf swing such that the distance rod and attached marker barrel are allowed to move longitudinally during the golf swing.

FIG. 6 illustrates a side view of the distance-determining mechanism and the release mechanism 30 during a swing of the club 10. The arrow indicates the direction of motion of the marker barrel 32 and attached distance rod 24 during the swing. Here, the release mechanism 30 is unlocked. Centrifugal force exerted upon the release nut 34 by the swing has urged the release sleeve 44 forward, thereby relieving the ball bearing 38 from the pressure exerted against the distance rod 24 by the collar 40, so that the ball bearing 38 no longer presses against and immobilizes the distance rod 24 and the attached marker barrel 32.

During the swing, the marker barrel 32 slides toward the head 20 of the club 10 until the centrifugal force of the swing is exactly balanced by the tension that this swing causes within the main spring 34. The distance rod 24 remains at this extended "post-swing" position because the release mechanism becomes "locked" at the zenith of the swing, when the opposing forces on the release nut 34 are balanced. The user is able to determine the force of the swing by reading calibrations which are associated with the circular openings 16.

Figure 7:
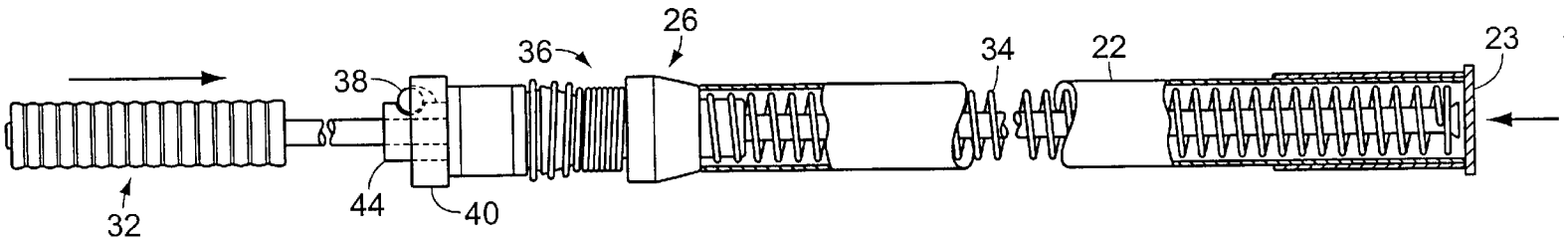
FIG. 7 is a side view wherein the distance rod and attached marker barrel are permitted to return to their pre-swing positions by pressing a release button to manually release the release mechanism.

FIG. 7 illustrates a side view of the distance rod 24 and attached marker barrel 32 returning to their pre-swing position, after the release mechanism 30 has been unlocked by pressing the reset button 23. An arrow adjacent to the release button 23 indicates the direction in which the release button 23 is pressed by a user. An arrow adjacent to the marker barrel 32 indicates the direction of motion of the marker barrel 32 after the release button 23 is pressed. Pressing the reset button 23 causes the underlying release tube 22 to push the release nut 34 forward toward the collar 40, compressing the attached release spring 36, thereby urging the release sleeve 44 toward the head 20 of the club 10. This causes the release sleeve 44 to move forward within the immobile collar 40, thereby allowing the ball bearing 38 to move slightly away from the enclosed distance rod 24, and thus releases the distance rod 24, so that the main spring 34 returns the marker barrel 32 to the pre-swing position, and "resets" the club 10 for the next use.

Figure 8:
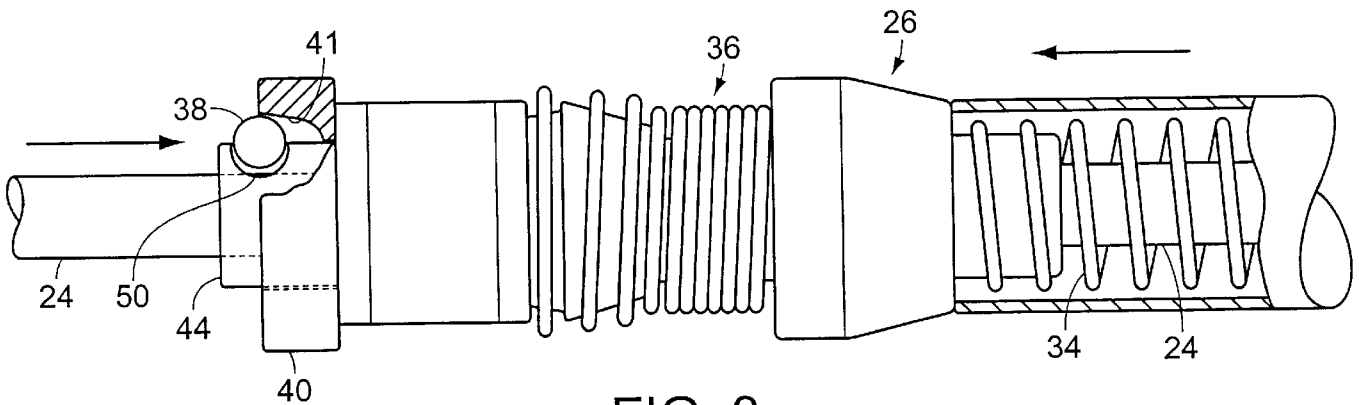
FIG. 8 is an enlarged side view of the release mechanism as shown in FIG. 7, illustrating how the forward movement of the release sleeve with respect to the collar allows the ball bearing to release the distance rod.

FIG. 8 illustrates an enlarged side view of the release mechanism 30, with a portion of the collar 40 broken away. Here, it is detailed how the release tube 22 is pushing the release sleeve 44 forward so that the ball bearing 38 is not pressed against the distance rod 24 by the camming surface 41 of the collar 40, and the distance rod 24 and attached marker barrel 32 are able to retract back to their pre-swing position by the tension within the compressed main spring 34.

In use, a user determines how far he/she would like to hit the golf ball on a particular occasion. The user then takes a practice swing with the golf club 10, wherein the golf ball is not hit. After the practice swing, the user determines the force of the practice swing, and the distance a golf ball would have traveled had it been hit by a swing of similar force to that of the practice swing, by viewing the position of the marker barrel 32 through one of the openings 16 through the shaft 14, and by ascertaining the associated force and distance from indicia surrounding the opening 16 which is adjacent to the marker barrel 32. The user unlocks the release mechanism 30 after each practice swing by pressing on the release button 23. The user repeats the practice swing, until the position of the marker barrel 24 within the shaft 14 indicates that the ball will travel the desired distance upon being hit by a swing of similar force. Now, armed with the knowledge of how hard to hit the ball, the user is ready to actually hit the ball.

In conclusion, herein is presented a golf club with an internal mechanism for measuring the force of a golf swing. The invention is illustrated by example in the drawing figures, and throughout the written description. It should be understood that numerous variations are possible, while adhering to the inventive concept. Such variations are contemplated as being a part of the present invention.

What is claimed is:

1. A golf club, for measuring the force of a golf swing and the distance a golf ball will travel after being hit by the golf club, comprising:

a club having a first end having a handle portion, a second end having a club head, and an elongated shaft located between the first end and the second end of the club, wherein the handle portion and the shaft are at least partially hollow, said shaft having an external surface and an internal bore, and a plurality of longitudinally arranged circular openings which extend fully from the external surface to the internal surface of the shaft;

a distance-determining mechanism, for allowing the user to gauge the force of a swing, and also the distance that the golf ball would travel if it were hit by a swing of similar force, said distance-determining mechanism having a selectively movable marker barrel, an attached distance rod, and an associated main spring, wherein the marker barrel and attached distance rod move toward the head of the club when the golf club is swung, and thereby displace the main spring from its pre-swing position to a post-swing position, wherein the position of the marker barrel within the shaft after the club has been swung is determined by the main spring and may be readily viewed through at least one of the plurality of longitudinally arranged circular openings within the shaft, and wherein the position of the marker barrel within the shaft indicates the particular force of a swing, and also the particular distance that a golf ball would travel if hit by the force of said swing; and a release mechanism, for selectively immobilizing the distance-determining mechanism, said release mechanism having a "release" position wherein the distance-determining mechanism is free to move within the shaft, and having a "lock" position wherein the distance-determining mechanism is immobilized within the shaft, wherein the release mechanism is "locked" before the swing of the club and thereby holds the distance-determining mechanism immobile, the release mechanism is momentarily "released" during the swing of the club, in order that the distance-determining mechanism may move to its post-swing, extended position within the shaft, and then is immediately locked following the swing to maintain the marker barrel in said post-swing, extended position.

2. The golf club as recited in claim 1, wherein the distance rod extends concentrically through the release mechanism, said release mechanism comprising a collar whose position is fixed within the shaft, a selectively movable hollow release sleeve which partially extends within said collar, said release sleeve having an external surface and an internal bore through which the distance rod extends, and a substantially hemispherical ball seat extending fully from the external surface to the internal bore of the release sleeve, said release mechanism also having a substantially spherical ball bearing which rests within the ball seat of the release sleeve, wherein the collar is movable with respect to the release sleeve to selectively press the ball bearing against the distance rod when in the locked position, and to allow the ball bearing to move slightly away from the distance rod when in the release position.

3. The golf club as recited in claim 2, wherein said release mechanism further comprises a release nut having a first end and a second end and an associated release spring, wherein said release nut is located closer to the first end of the club than the collar, wherein the release spring extends between the second end of the release nut and the collar, the golf club as recited further comprises a release tube having a first end and a second end, wherein the first end of said release tube partially extends from the handle portion of the club, said release tube being in mechanical contact at its second end with the release nut, wherein in the absence of an applied force, the release spring biases the release nut away from the collar and thus biases the release mechanism to the locked position wherein the ball is held against the distance rod to keep the distance rod stationary, and wherein in the presence of the centrifugal force of the swing urging the release nut toward the collar or by manually pressing upon the first end of the release tube, the release spring momentarily urges the release sleeve distally forward through the overlying collar, thereby relieving the pressure exerted by the collar upon the ball bearing and the underlying distance rod, thereby allowing the distance rod to move within the release mechanism.

4. The golf club as recited in claim 3, wherein the release mechanism further comprises a release button, said release button in mechanical contact with the first end of the release tube, wherein pressing down upon the release button after a swing is complete causes the release tube to press upon the release nut, thereby urging the release sleeve momentarily toward the head of the club, in order that the distance-determining mechanism may return to its pre-swing position within the club.

5. A method of using a golf club for determining the force of a golf swing and also the distance a golf ball will travel after being impacted by the swing, said golf club having a club having a first end having a handle portion, a second end having a club head, and an elongated shaft located between the first end and the second end of the club, wherein the handle portion and the shaft are at least partially hollow, said shaft having an external and an internal surface, and a plurality of longitudinally arranged openings which extend fully from the external surface to the internal surface of the shaft, said golf club further having a distance-determining mechanism, for allowing the user to gauge the force of a swing, said distance-determining mechanism having a selectively movable marker barrel, an attached distance rod, and an associated main spring, wherein the marker barrel and attached distance rod move toward the head of the club when the golf club is swung, and thereby displace the main spring from its pre-swing position, said golf club also having a release mechanism, for selectively immobilizing the distance determining-mechanism, having a "release" position in which the distance-determining mechanism is free to move within the shaft, and also a "lock" position in which the distance-determining mechanism is immobilized within the shaft, comprising the steps of:

a) taking a practice swing by the user with the golf club, wherein the golf ball is not hit, thereby unlocking the release mechanism, and thereby allowing the marker barrel and attached distance rod to move within the shaft to a post-swing position wherein the marker barrel is visible through one of the openings;

b) immobilizing the marker barrel and distance rod at their post-swing position by locking the release mechanism immediately after the swing;

c) determining by the user of the force of the practice swing, and the distance a golf ball would have traveled had it been hit by a swing of similar force to that of said practice swing, by viewing the position of the marker barrel within the shaft through one of the openings;

d) allowing the mainspring to return the marker barrel to its pre-swing position by unlocking the release mechanism by the user after the swing;

e) repeating by the user of steps (a) through (d) until the position of the marker barrel within the shaft after a particular swing indicates to the user that the ball will travel the desired distance upon being hit by a swing of similar force; and f) hitting the ball by the user with the same amount of force as said particular swing which indicates to the user that the ball will travel the desired distance.

* * * * *